US010876365B2

(12) United States Patent
Thomas et al.

(10) Patent No.: US 10,876,365 B2
(45) Date of Patent: Dec. 29, 2020

(54) ADJUSTABLE AND REDRESSABLE COLLET

(71) Applicant: Halliburton Energy Services, Inc., Houston, TX (US)

(72) Inventors: Phillip Terry Thomas, The Colony, TX (US); Christopher Robert Delzell, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 225 days.

(21) Appl. No.: 15/537,369

(22) PCT Filed: Sep. 14, 2016

(86) PCT No.: PCT/US2016/051640

§ 371 (c)(1),
(2) Date: Jun. 16, 2017

(87) PCT Pub. No.: WO2018/052408

PCT Pub. Date: Mar. 22, 2018

(65) Prior Publication Data

US 2019/0010772 A1 Jan. 10, 2019

(51) Int. Cl.

| | |
|---|---|
| ***E21B 23/03*** | (2006.01) |
| ***E21B 19/00*** | (2006.01) |
| ***E21B 23/02*** | (2006.01) |
| ***E21B 17/00*** | (2006.01) |
| ***E21B 23/01*** | (2006.01) |

(52) U.S. Cl.

CPC ..... *E21B 23/03* (2013.01); *E21B 17/00* (2013.01); *E21B 19/00* (2013.01); *E21B 23/01* (2013.01); *E21B 23/02* (2013.01)

(58) Field of Classification Search

CPC ..... E21B 17/00; E21B 19/00; E21B 23/03; E21B 23/01; E21B 23/02; E21B 23/00; E21B 17/06; E21B 17/02; E21B 34/14

See application file for complete search history.

(56) References Cited

U.S. PATENT DOCUMENTS

| | | | | |
|---|---|---|---|---|
| 8,783,368 | B2 | 7/2014 | Eriksen et al. | |
| 2013/0161027 | A1 | 6/2013 | Inglis et al. | |
| 2014/0196889 | A1 | 7/2014 | Oberg et al. | |
| 2016/0053583 | A1* | 2/2016 | Hayter | E21B 23/00 166/237 |
| 2016/0230478 | A1 | 8/2016 | Dietz | |
| 2016/0335464 | A1* | 11/2016 | Ownby | G06K 7/10316 |

FOREIGN PATENT DOCUMENTS

WO 2015/039110 A1 3/2015

OTHER PUBLICATIONS

International Search Report and Written Opinion for PCT/US2016/051640 dated May 31, 2017.

* cited by examiner

*Primary Examiner* — Lee A Holly
(74) *Attorney, Agent, or Firm* — McGuireWoods LLP

(57) ABSTRACT

A collet includes a cylindrical body, and a plurality of longitudinally-extending orifices defined through the body and thereby providing one or more axially-extending collet fingers. A collet lug is removably coupled to each axially-extending collet finger.

9 Claims, 5 Drawing Sheets

ADJUSTABLE AND REDRESSABLE COLLET

BACKGROUND

In the oil and gas industry, collets are tools that have been used for a variety of downhole operations, such as a great many types of downhole tool holding and releasing operations. Briefly, a collet is a deflective structure constructed to deflect radially outwardly or radially inwardly, and resiliently return to an initial position. Collets are typically tubular in form and have a plurality of axially extending collet fingers created by cutting elongate, axially extending orifices in a tubular. The collet fingers are able to flex radially inward or outward upon assuming a corresponding inward or outward radial force.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole tools and, more particularly, to collets that have removable collet lugs that can be replaced, rehabilitated, and/or adjusted to restore or manipulate the snap force for a given collet.

Over long durations of use of a collet, including repeated axial engagements and disengagements of the collet lugs included in the collet with indicating profiles located within a wellbore, the snap force of the collet will decrease due to marring, damage, and wear assumed by the collet lugs. The embodiments disclosed herein describe collet designs and methods of increasing the snap force of the collet. More specifically, the collets described herein have collet lugs that are removably coupled to corresponding collet fingers, such as with mechanical fasteners or another type of reversible mechanical attachment means. When the snap force of a given collet descends below a predetermined snap force threshold, the collet may be retrieved to surface and the used collet lugs may be removed from the collet fingers. Once removed, the used collet lugs may be replaced, rehabilitated, or moved to a different axial location on the collet fingers, and thereby increase or restore the snap force of the collet.

Figure 1:
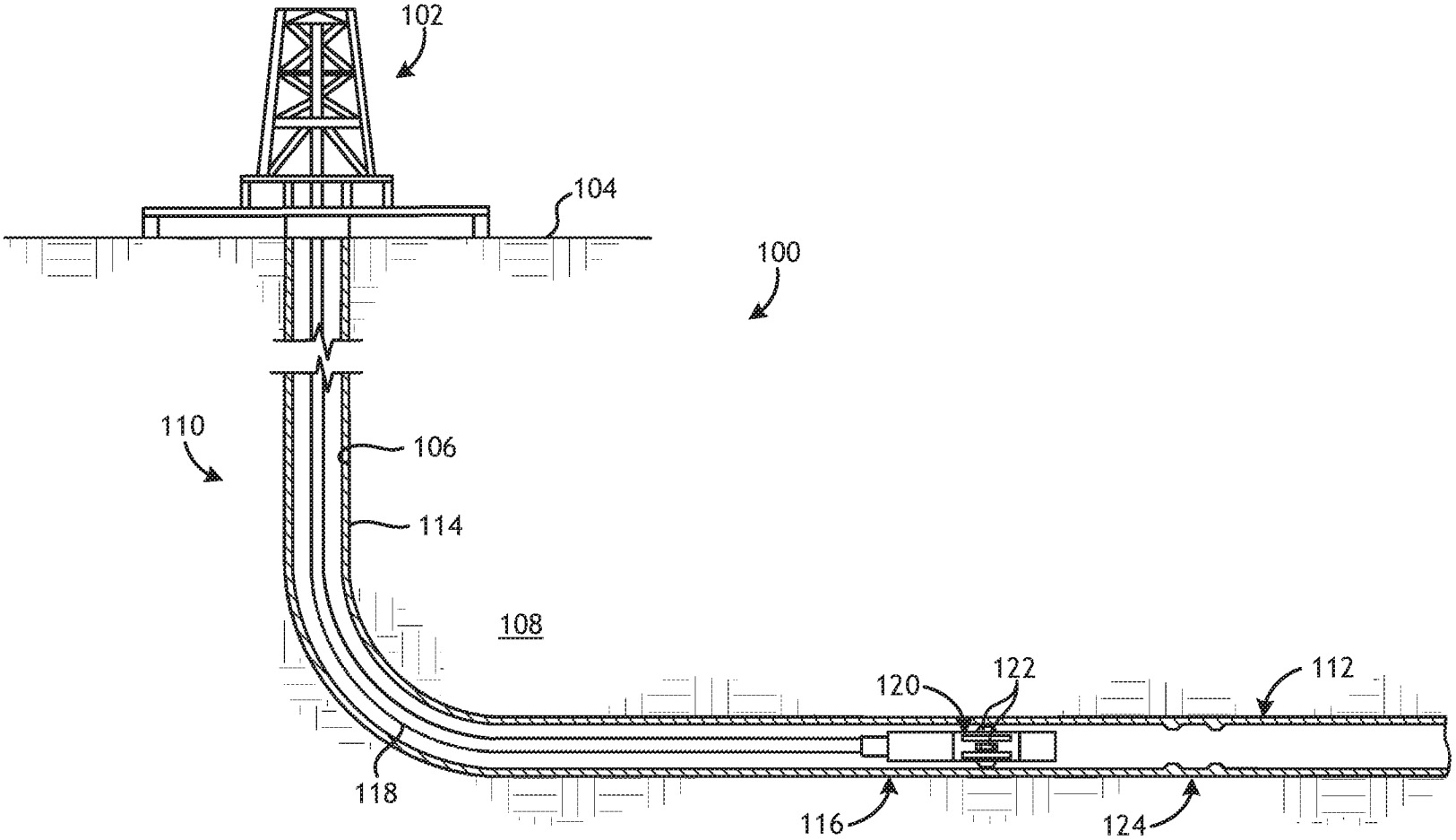
FIG. 1 is a schematic diagram of a well system that may employ one or more principles of the present disclosure.

FIG. 1 is a schematic diagram of a well system 100 that may employ one or more principles of the present disclosure, according to one or more embodiments. As illustrated, the well system 100 may include a service rig 102 positioned on the Earth's surface 104 and extending over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. Moreover, while the well system 100 is depicted as a land-based operation, it will be appreciated that the principles of the present disclosure could equally be applied in any offshore, sea-based, or sub-sea application where the service rig 102 may be a floating platform, a semi-submersible platform, or a subsurface wellhead installation as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the Earth's surface 104 and transition into a substantially horizontal wellbore portion 112. In some embodiments, the wellbore 106 may be completed by cementing a string of casing 114 within the wellbore 106 along all or a portion thereof. In other embodiments, however, the casing 114 may be omitted from all or a portion of the wellbore 106 and the principles of the present disclosure may equally apply to an "open-hole" environment.

The system 100 may further include a downhole tool 116 conveyable into the wellbore 106 on a conveyance 118 extending from the service rig 102. In some applications, the downhole tool 116 may comprise a service tool or the like used to manipulate another downhole tool. The conveyance 118 may be, but is not limited to, casing, coiled tubing, drill pipe, production tubing, or any other rigid, tubular member.

The downhole tool 116 may comprise and otherwise include a collet 120, which provides a plurality of collet lugs 122 extending radially outward from a corresponding plurality of collet fingers (not labeled) defined on the collet 120. The general shape and size of the collet lugs 122 provide an outer profile configured to mate with a corresponding indicating profile of a downhole structure or tool. In the illustrated embodiment, for instance, the casing 114 may provide an indicating profile 124 configured to receive and mate with the lugs 122 of the collet 120. In other embodiments, however, the indicating profile 124 may be defined on any structure or tool locatable and/or securable within the wellbore 106.

Upon locating the indicating profile 124, an axial load may be applied to the collet 120 in the downhole direction via the conveyance 118 to force the lugs 122 into the indicating profile 124. Once the collet 120 properly mates with the indicating profile 124, the downhole tool 116 will be secured in place at the location of the indicating profile 124. When it is desired to move the downhole tool 116 once again, another axial load is applied to the collet 120 via the conveyance 118 in either the downhole or uphole directions and, upon assuming the axial load, the lugs 122 will snap out of engagement with the indicating profile 124 and thereby free the downhole tool 116.

Even though FIG. 1 depicts the downhole tool 116 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well.

Figure 2A:
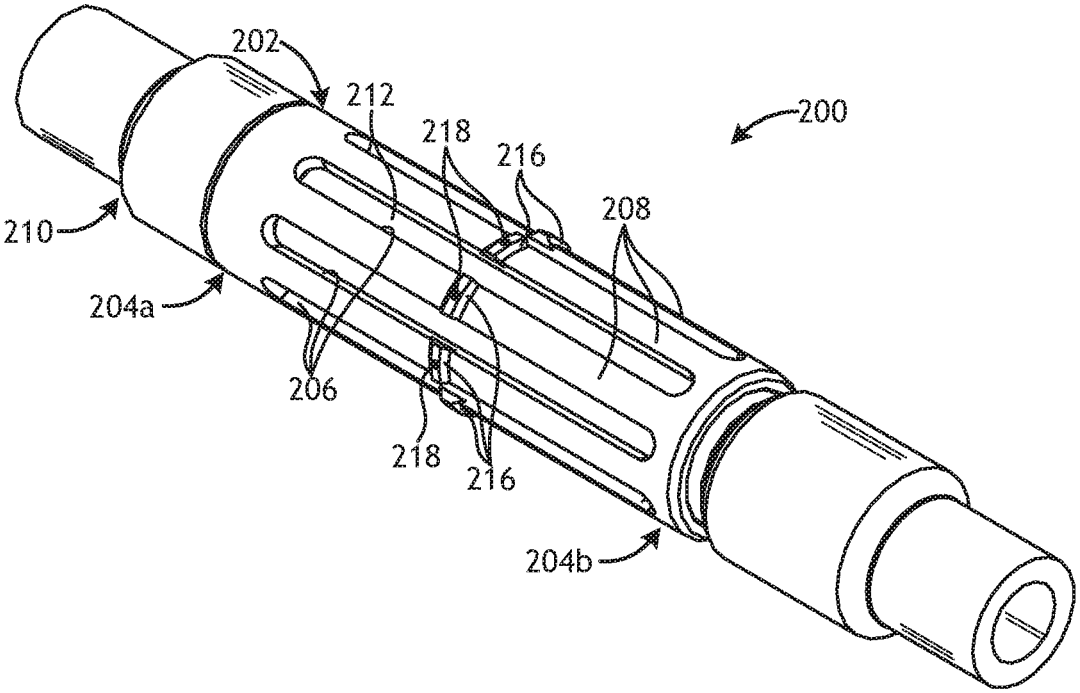
FIGS. 2A and 2B are views of an exemplary embodiment of a collet.
Figure 2B:
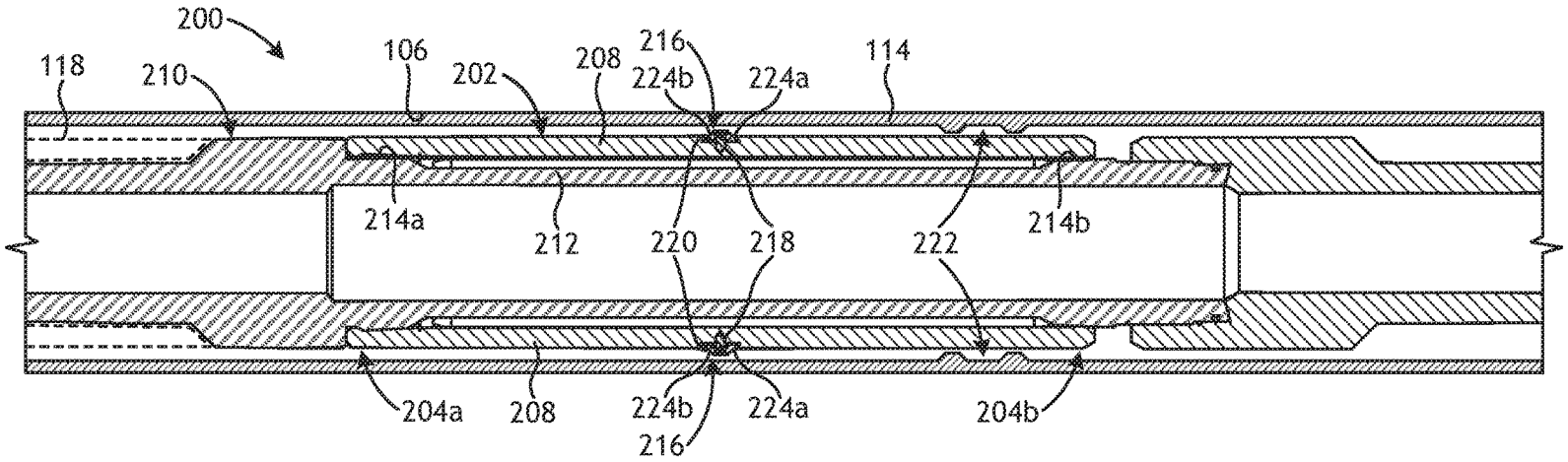

FIGS. 2A and 2B are views of an exemplary embodiment of a collet 200, according to one or more embodiments. More particularly, FIG. 2A is an isometric view of the collet 200, and FIG. 2B is a cross-sectional side view of the collet 200. The collet 200 may be the same as or similar to the collet 120 of FIG. 1 and, therefore, may be conveyed into the wellbore 106 (FIG. 2B) on the conveyance 118 (shown in dashed lines in FIG. 2B). As illustrated, the collet 200 may include a generally cylindrical body 202 having a first end 204*a* and a second end 204*b* opposite the first end 204*a*. A plurality of longitudinally extending orifices 206 are defined through the body 202, and thereby provide at least one axially extending collet finger 208.

In the illustrated embodiment, a plurality of collet fingers 208 are depicted as generally extending between the first and second ends 204*a,b* but do not extend axially through or penetrate either of the first and second ends 204*a,b*. In such embodiments, the body 202 radially supports the collet fingers 208 at each end 204*a,b* but allows the collet fingers 208 to radially deflect in the central region. In other embodiments, however, the collet fingers 208 may extend from one of the first or second ends 204*a,b* and extend through and otherwise penetrate the opposing end. In such embodiments, the collet fingers 208 will be radially supported at only one end and operate as cantilever beams or extensions able to radially deflect at the opposing end.

In some embodiments, the collet 200 may be coupled to and otherwise extend about a collet mandrel 210. The collet mandrel 210 may include an elongate body 212 and the collet 200 may be configured to receive and extend about the outer diameter of at least a portion of the elongate body 212. The collet mandrel 210 may be operatively coupled to the conveyance 118. In other embodiments, however, the collet mandrel 210 may be omitted and the collet 200 may instead be operatively coupled to the conveyance 118 at the first end 204*a*.

In the illustrated embodiment, the body 212 of the collet mandrel 210 provides first and second radial shoulders 214*a* and 214*b* that extend radially outward. Upon receiving the collet mandrel 210, the collet 200 may be radially supported at the first and second ends 204*a,b* with the corresponding first and second radial shoulders 214*a,b*, respectively. In other embodiments, however, the collet mandrel 210 may alternatively provide only one of the first and second radial shoulders 214*a,b*. In such embodiments, the collet 200 may be radially supported by the collet mandrel 210 at only one of the first and second ends 204*a,b*.

The collet 200 may further include at least one collet lug 216 secured to each collet finger 208 and extending radially outward therefrom. In some embodiments, as illustrated, the collet lugs 216 may be secured to the collet fingers 208 at an intermediate or central location between the first and second ends 204*a,b*. In other embodiments, however, the collet lugs 216 may be secured to the collet fingers 208 at a location offset from the central location and otherwise closer to one of the first or second ends 204*a,b*.

According to the present disclosure, the collet lugs 216 may be removably coupled to the corresponding collet fingers 208. As used herein, the term "removably coupled" refers to any reversible mechanical attachment means that secures a given collet lug 216 to the outer radial surface of a corresponding collet finger 208, and is further able to be reversed to remove the given collet lug 216 from the corresponding collet finger 208 when desired.

The collet lugs 216 may be removably coupled to the outer and/or the inner diameter of the corresponding collet fingers 208. In some embodiments, as illustrated, the collet lugs 216 may be located on the outer diameter (outer radial surface) of the corresponding collet fingers 208. In other embodiments, however, the collet lugs 216 may be located on the inner diameter (inner radial surface), or both the outer and inner diameters, of the corresponding collet fingers 208, without departing from the scope of the disclosure. Having collet lugs 216 on the inner and outer diameters may allow the collet lugs 216 on the outer diameter to locate and engage an indicating profile (e.g., the indicating profile 124 of FIG. 1), while the collet lugs 216 located on the inner diameter may be configured to snap out of an outer profile (not shown) provided on the collet mandrel 210, for example.

In some embodiments, as illustrated, one or more of the collet lugs 216 may be removably coupled to a corresponding collet finger 208 using a mechanical fastener 218, such as a bolt, a set screw, rivets, interference fit pins, or the like. When desired, the mechanical fasteners 218 may be removable to enable a user to remove the collet lugs 216.

In some embodiments, as best seen in FIG. 2B, one or more of the collet lugs 216 may be received and otherwise seated within a groove 220 defined in the outer surface of the corresponding collet finger 208. In at least one embodiment, the groove 220 may be defined on the inner surface of the corresponding collet finger 208, or grooves 220 may be defined on both the outer and inner surfaces, without departing from the scope of the disclosure. In embodiments that include the grooves 220, one or more of the collet lugs 216 may be removably coupled to a corresponding collet finger 208 by shrink fitting or interference fitting the collet lugs 216 in the grooves 220. When desired, the collet lugs 216 may be removed by reversing the shrink or interference fitting process. In other embodiments, one or more of the collet lugs 216 may be removably coupled to a corresponding collet finger 208 by placing the collet lugs 216 in the grooves 220 and using an adhesive to secure the collet lugs 216 within the grooves 220. When desired, the collet lugs 216 may be removed by dissolving or etching the adhesive. In yet other embodiments, one or more of the collet lugs 216 may be removably coupled to a corresponding collet finger 208 by welding, such as by fixing the collet lugs 216 to the collet fingers 208 using one or more tack welds. When desired, the collet lugs 216 may be removed using a grinding wheel, for example. In even further embodiments, one or more of the collet lugs 216 may be removably coupled to a corresponding collet finger 208 using a combination of two or more of the foregoing reversible mechanical attachment means.

In the illustrated embodiment, the cross-sectional shape of the groove 220 is a dovetail shape and the collet lugs 216 are correspondingly shaped with angled surfaces to be received within the dovetail-shaped grooves 220. In other embodiments, however, one or more of the grooves 220 may exhibit a squared-off cross-sectional shape, without departing from the scope of the disclosure. The grooves 220 may prove advantageous in helping secure the collet lugs 216 to the collet fingers 208 for long-term use. More specifically, the inner walls of the grooves 220 may provide an additional amount of axial support for the collet lugs 216 during operation.

With reference to FIG. 2B, exemplary operation of the collet 200 is now provided. The collet 200 may be conveyed into the wellbore 106 until reaching a target location. In some cases, the target location may be a location where a downhole tool is to be deployed or where a downhole operation is to be undertaken. An indicating profile 222 may be provided at the target location, and the collet 200 may be configured to locate and mate with the indicating profile 222. In some embodiments, as illustrated, the indicating profile 222 may be defined and otherwise provided on the inner radial surface of the casing 114. In other embodiments, however, the indicating profile 222 may be provided by any other downhole tool or structure present in the wellbore 106 and configured to mate with the collet 200.

The collet lugs 216 may provide and otherwise define an outer profile configured to locate and mate with the indicating profile 222. More particularly, the collet lugs 216 may include a first or downhole surface 224*a* and a second or uphole surface 224*b*. The first and second surfaces 224*a,b* may be configured to engage corresponding surfaces the indicating profile 222 and thereby urge the collet lugs 216 radially inward to snap into and out of engagement with the indicating profile 222. In some embodiments, to help ease the transition of the collet 220 into and out of the indicating profile 222, the first and second surfaces 224*a,b* may be angled and otherwise sloped with respect to a longitudinal axis of the collet 200. The angle of the first and second surfaces 224*a,b* has a direct impact on the axial load required to radially deflect the collet fingers 208. The angle of the first and second surfaces 224*a,b* may range between about 5° to about 85°, but preferably between about 15° and about 60°. Moreover, the angle of first and second surfaces 224*a,b* need not be the same. Optimizing the angle of the first and second surfaces 224*a,b* is one way to control the snap value of the collet 200.

Upon reaching the target location in the downhole direction (e.g., to the right in FIG. 2B), the first surface 224*a* of the collet lugs 216 will axially engage the uphole surface of the indicating profile 222. An axial load may then be applied to the collet 220 and the collet lugs 216 will slide against the uphole surface of the indicating profile 222 and the collet fingers 208 will correspondingly flex radially inward. Further downhole movement of the collet 200 will allow the collet fingers 208 to resiliently flex radially outward as the collet lugs 216 mate with (snap into) the indicating profile 222. The foregoing process is reversed to remove the collet 200 from the indicating profile 222, or otherwise the collet 200 may be pushed through the indicating profile 222 in the downhole direction as the collet fingers 208 and associated collet lugs 216 flex radially inward and out of mating engagement with the profile 222.

Over long durations of use and numerous engagements and disengagements with the indicating profile 222 (and other indicating profiles), the snap force of the collet 200 may decrease and otherwise become diminished. The snap force of the collet 200 refers to the axial force or load required to flex the collet fingers 208 radially inward such that the collet lugs 216 are able to axially traverse at least one protrusion or "hump" of a given indicating profile. The snap force will decrease due to marring, damage, and wear assumed by the collet lugs 216 through repeated axial engagement with the indicating profile 222 (and other indicating profiles). For instance, the edges of the first and second surfaces 224*a,b* of the collet lugs 216 will eventually wear and become damaged through repeated axial engagement of the collet lugs 216 against the indicating profile 222. As the edges of the first and second surfaces 224*a,b* wear down, the snap force of the collet 200 correspondingly decreases and it therefore becomes easier to "snap" into a given indicating profile.

When the snap force of a given collet is reduced, the collet becomes unsuitable for its intended purpose and will typically be returned to the surface and replaced with a new collet exhibiting the required snap force. According to the present disclosure, however, instead of replacing the collet 200 when the corresponding snap force descends below a predetermined snap force threshold, the collet lugs 216 may be replaced or rehabilitated. With new or rehabilitated collet lugs 216 installed in the collet 200, the snap force will return to its designed value and the collet 200 may again be deployed downhole.

Replacing the collet lugs 216 may entail disconnecting the used collet lugs 216 from the collet fingers 208 by removing the reversible mechanical attachment means. In the illustrated embodiments, this entails removing the mechanical fasteners 218 that attach the collet lugs 216 to the collet fingers 208. Once the used collet lugs 216 are disconnected, new collet lugs 216 may be secured (removably coupled) to the collet fingers 208 with the mechanical fasteners 218 or by any of the other reversible mechanical attachment means mentioned herein.

In embodiments where the collet 200 includes the grooves 220, replacing the used collet lugs 216 may further entail extricating the used collet lugs 216 from the corresponding grooves 220 after the reversible mechanical attachment means (e.g., the mechanical fasteners 218) is removed. The new collet lugs 216 may then be inserted into the corresponding grooves 220 and secured thereto using the mechanical fasteners 218 or by any of the other reversible mechanical attachment means mentioned herein.

In some embodiments, the new collet lugs 216 may be made of the same material as the used collet lugs 216, such as carbon steel, stainless steel, high nickel alloys, and any combination thereof. In other embodiments, however, the used collet lugs 216 may be replaced with new collet lugs 216 that are made of a hard material, such as ultra-hard or erosion-resistant materials. Suitable hard materials include, but are not limited to, a carbide (e.g., tungsten, titanium, tantalum, vanadium, etc.), a carbide embedded in a matrix of cobalt or nickel by sintering, a ceramic, a surface hardened metal (e.g., nitrided metals, heat-treated metals, carburized metals, etc.), a surface coated metal, a cermet-based material, a metal matrix composite, a nanocrystalline metallic alloy, an amorphous alloy, a hard metallic alloy, diamond, a metal boride, or any combination thereof.

Rehabilitating the collet lugs 216 may entail disconnecting the used collet lugs 216 from the collet fingers 208 by removing the reversible mechanical attachment means (e.g., the mechanical fasteners 218) that attach the collet lugs 216 to the collet fingers 208. Once the used collet lugs 216 are disconnected, the used collet lugs 216 may undergo one or more restorative processes to repair or recondition the used collet lugs 216. Once the used collet lugs 216 are rehabilitated by undergoing the restorative processes, the rehabilitated collet lugs 216 may once again be secured to the collet fingers 208 with the mechanical fasteners 218 or by any of the other reversible mechanical attachment means mentioned herein.

One exemplary restorative process entails hardfacing the used collet lugs 216 to build up the material of the first and second surfaces 224*a,b* and thereby restore the collet lugs 216 to their original shape and mass. The hardfacing can be applied to the desired surfaces of the collet lugs 216 via a variety of hardfacing techniques such as, but not limited to, oxyacetylene welding (OXY), atomic hydrogen welding (ATW), welding via tungsten inert gas (TIG), gas tungsten arc welding (GTAW), shielded metal arc welding (SMAW), gas metal arc welding (GMAW—including both gas-shielded and open arc welding), oxyfuel welding (OFW), submerged arc welding (SAW), electroslag welding (ESW), plasma transferred arc welding (PTAW—also called powder plasma welding), additive/subtractive manufacturing, thermal spraying, cold polymer compounds, laser cladding, hardpaint, and any combination thereof.

A wide variety of hardfacing materials may be used to rehabilitate the collet lugs 216. One suitable hardfacing material is sintered tungsten carbide particles in a steel alloy matrix. The tungsten carbide particles may include grains of monotungsten carbide, ditungsten carbide and/or macrocrystalline tungsten carbide. Spherical cast tungsten carbide may typically be formed with no binding material. Examples of binding materials used to form tungsten carbide particles may include, but are not limited to, cobalt, nickel, boron, molybdenum, niobium, chromium, iron and alloys of these elements. Other hard constituent materials include cast or sintered carbides consisting of chromium, molybdenum, niobium, tantalum, titanium, vanadium and alloys and mixtures thereof.

Figure 3A:
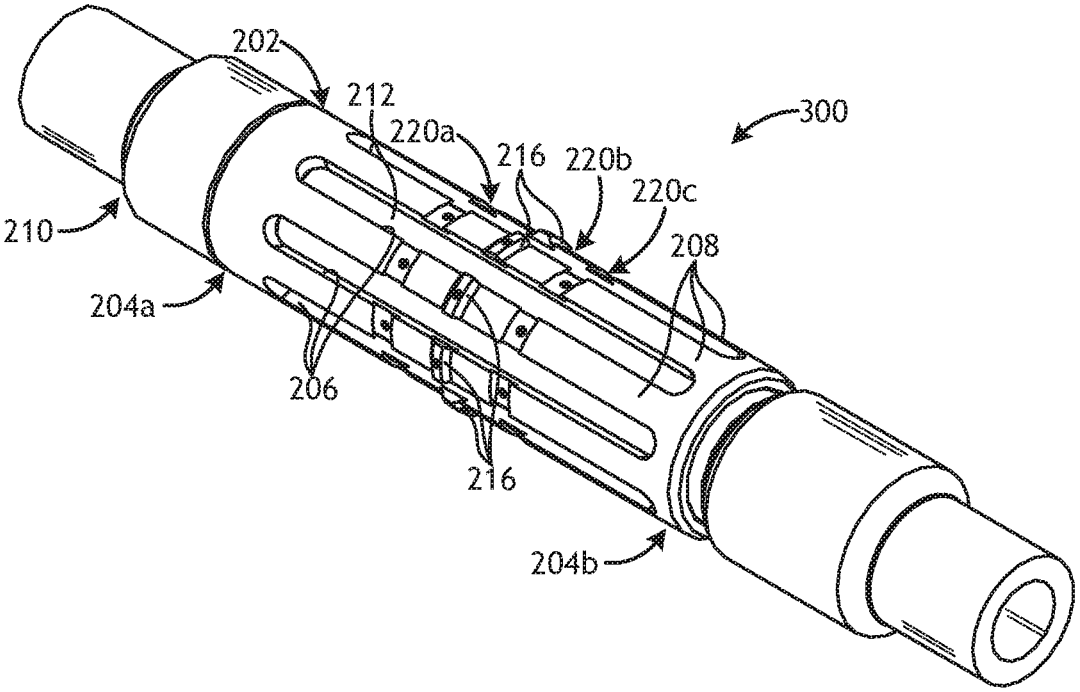
FIGS. 3A and 3B are views of another exemplary embodiment of a collet.
Figure 3B:
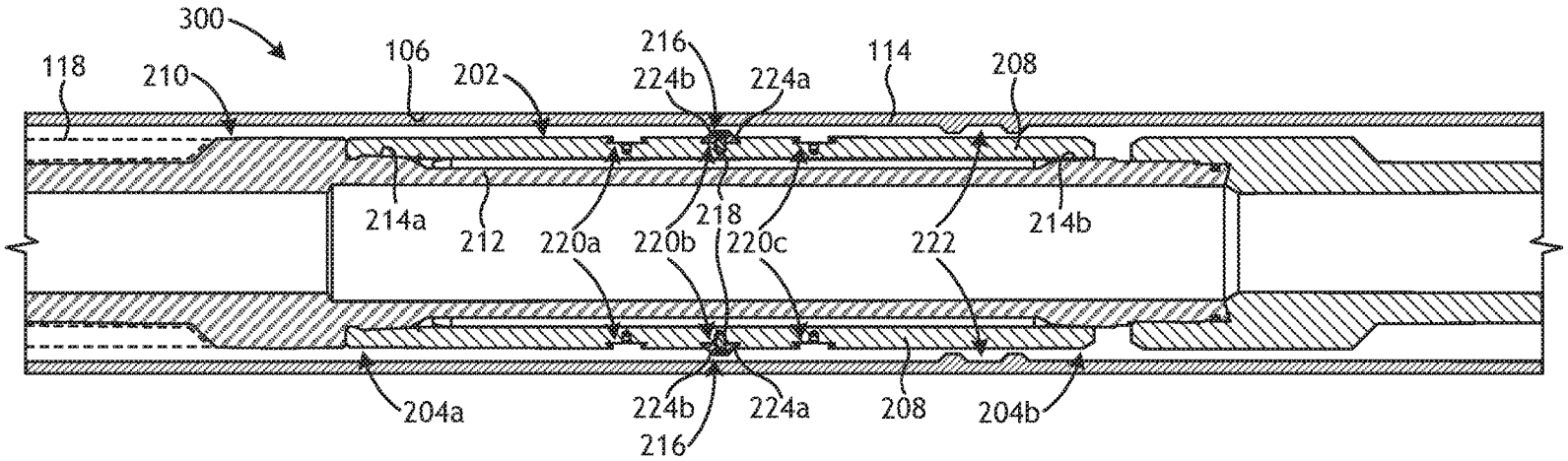

FIGS. 3A and 3B are views of another exemplary embodiment of a collet 300, according to one or more embodiments. More particularly, FIG. 3A is an isometric view of the collet 300, and FIG. 3B is a cross-sectional side view of the collet 300. Similar to the collet 200 of FIGS. 2A-2B, the collet 300 may be the same as or similar to the collet 120 of FIG. 1 and, therefore, may be conveyed into the wellbore 106 (FIG. 3B) on the conveyance 118 (shown in dashed lines in FIG. 3B). The collet 300 may similar in some respects to the collet 200 of FIGS. 2A-2B and therefore may be best understood with reference to the, where like numerals will represent like elements or components not described again in detail.

Similar to the collet 200 of FIGS. 2A-2B, the collet 300 may include the body 202, the plurality of longitudinally-extending orifices 206 defined through the body 202, and the resulting axially-extending collet fingers 208. Moreover, in some embodiments, the collet 300 may be coupled to and otherwise extend about the collet mandrel 210, but the collet mandrel 210 may alternatively be omitted from this embodiment, without departing from the scope of the disclosure. The collet 300 may further include the one or more collet lugs 216 secured to each collet finger 208 and extending radially outward therefrom.

Unlike the collet 200 of FIGS. 2A-2B, however, the collet 300 may include two or more sets of grooves 220 defined in the outer surface (or inner surface, or both) of the collet fingers 208 and configured to receive and seat the collet lugs 216. In the illustrated example, for instance, the collet 300 includes and otherwise defines a first set of grooves 220*a*, a second set of grooves 220*b*, and a third set of grooves 220*c*. Each set of grooves 220*a-c* is axially offset from one another along the length of the collet fingers 208, and the second set of grooves 220*b* axially interposes the first and third sets of grooves 220*a,c*. While three sets of grooves 220*a-c* are shown in FIGS. 3A-3B, more or less than three may be employed, without departing from the scope of the disclosure. Moreover, while the sets of grooves 220*a-c* are depicted as having a plurality of grooves 220, each set of grooves 220*a-c* may alternatively have only one groove 220, without departing from the scope of the disclosure.

In the illustrated embodiment, the cross-sectional shape of each set of grooves 220*a-c* is a dovetail shape. In other embodiments, however, one or more of the sets of grooves 220*a-c* may exhibit a squared-off cross-sectional shape, without departing from the scope of the disclosure. Moreover, the collet lugs 216 may be removably coupled to the corresponding collet fingers 208 at any one of the sets of grooves 220*a-c* using any of the reversible mechanical attachment means described herein. In the illustrated embodiment, for example, the collet lugs 216 are removably coupled to the collet fingers 208 within the second set of grooves 220*b* using the mechanical fasteners 218. In other embodiments, however, the collet lugs 216 may be removably coupled within the second set of grooves 220*b* by shrink fitting, interference fitting, or by using an adhesive, as generally described above, or by using a combination of two or more of the foregoing reversible mechanical attachment means.

Exemplary operation of the collet 300 is substantially similar to the above-described operation of the collet 200 of FIGS. 2A-2B and, therefore, will not be repeated. As with the collet 200, over long durations of use of the collet 300 and repeated axial engagements and disengagements of the collet lugs 216 with the indicating profile 222 (and other indicating profiles), the snap force of the collet 300 will decrease due to marring, damage, and wear assumed by the collet lugs 216. When the snap force of the collet 300 descends below a predetermined snap force threshold, the collet 300 may be retrieved to surface and the collet lugs 216 may be replaced or rehabilitated, as generally described above. With new or rehabilitated collet lugs 216 installed in the collet 300, the snap force will return to its designed value and the collet 300 may again be deployed downhole for use.

In some embodiments, however, the snap force of the collet 300 may be increased or otherwise manipulated by moving the collet lugs 216 to another set of grooves 220*a-c* provided on the collet fingers 208. The distance that a given collet lug 216 is positioned relative to a radially supported end of a corresponding collet finger 208 directly impacts the axial-to-radial-load required to radially deflect the collet finger 208. This is sometimes referred to as the "deflection potential" for the collet finger. In the illustrated embodiment, for example, the collet lugs 216 are secured to the collet fingers 208 at the second set of grooves 220*b*, which is provided at a location spaced equally from the radially supported first and second ends 204*a,b* of the body 202. Since the collet lugs 216 are secured at a location equally spaced from the radially-supported first and second ends 204*a,b*, the deflection potential of the collet fingers 208 will be at a maximum, and the snap force of the collet 300 will exhibit a value or magnitude based on the deflection potential. Moving the collet lugs 216 to the first or second sets of grooves 220*a,c*, however, will decrease the deflection potential of the collet 300 since the collet lugs 216 will then be located closer to the radially supported first and second ends 204*a,b*, which decreases the length of the deflection beam of each collet finger 208. Such a decrease in the deflection potential equates to a corresponding increase in the snap force of the collet 300.

In one or more embodiments, the sets of grooves 220*a-c* may be omitted from the collet 300, but the snap force of the collet 300 may nonetheless be increased or otherwise manipulated by moving the collet lugs 216 closer to the first or second radially supported ends 204*a,b* of the body 202. In such embodiments, the collet lugs 216 may be removably coupled to the outer radial surface of the collet fingers 208 at a first location. To increase the snap force of the collet 300 and otherwise decrease the deflection potential of the collet fingers 208, the collet lugs 216 may be removed from the collet fingers 208 and relocated to a second position closer to the first or second radially supported ends 204*a,b* of the body 202. At the second position, the collet lugs 216 may again be removably coupled to the outer radial surface of the collet fingers 208 using any of the reversible mechanical attachment means mentioned herein.

Figure 4:
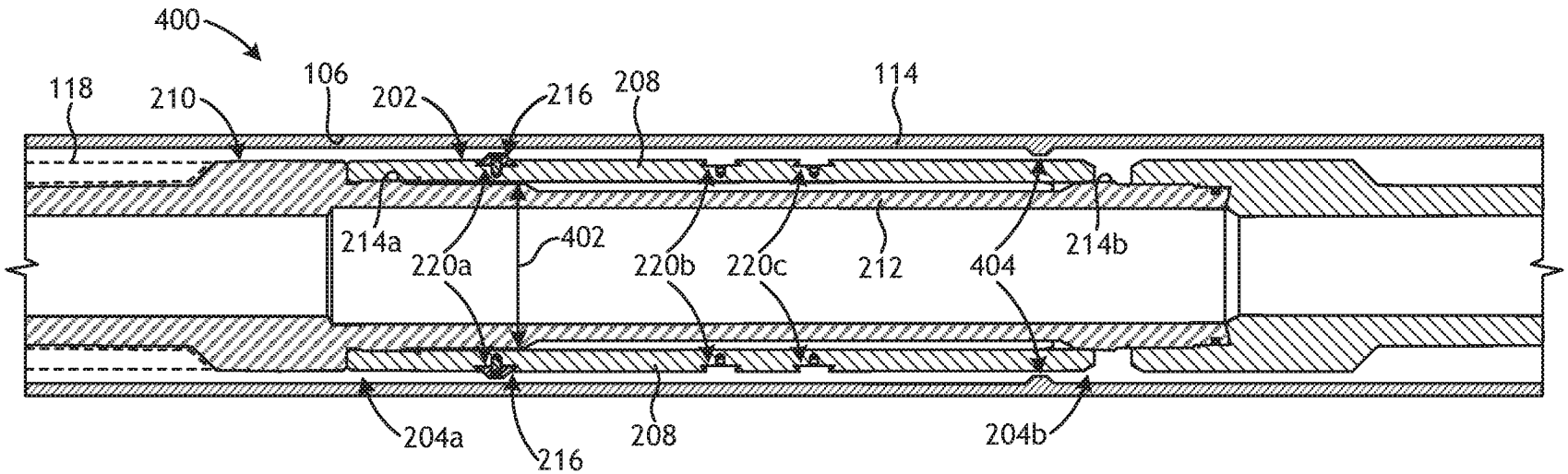
FIG. 4 is a cross-sectional side view of another exemplary embodiment of a collet.

FIG. 4 is a cross-sectional view of another exemplary embodiment of a collet 400, according to one or more embodiments. Similar to the collets 200 and 300 of FIGS. 2A-2B and 3A-3B, respectively, the collet 400 may be the same as or similar to the collet 120 of FIG. 1 and, therefore, may be conveyed into the wellbore 106 on the conveyance 118 (shown in dashed lines). Moreover, the collet 400 may similar in some respects to the collets 200 and 300 of FIGS. 2A-2B and 3A-3B, respectively, and therefore may be best understood with reference to the, where like numerals will represent like elements or components not described again in detail.

Similar to the collets 200 and 300, for instance, the collet 400 may include the body 202 and the axially-extending collet fingers 208. In some embodiments, the collet 400 may be coupled to and otherwise extend about the collet mandrel 210. The collet 400 may further include the one or more collet lugs 216 secured to each collet finger 208 and extending radially outward therefrom. Moreover, the collet 400 may include two or more sets of grooves 220*a-c* defined in the outer surface (or inner surface, or both) of the collet fingers 208 and configured to receive and seat the collet lugs 216.

In the illustrated embodiment, the collet lugs 216 are removably coupled to the first set of grooves 220*a*, which are defined at or near the first ends 204*a* of the body 202. The collet lugs 216 are axially aligned with and positioned radially adjacent an enlarged outer diameter portion 402 of the elongate body 212 of the collet mandrel 210. In at least one embodiment, for example, the enlarged outer diameter portion 402 may comprise an axial extension of the first radial shoulder 214*a*, but could alternatively comprise any enlarged diameter portion of the collet mandrel 210 configured to axially align with any of the grooves 220*a-c*.

The enlarged outer diameter portion 402 may exhibit a diameter that is larger than the remaining portions of the elongate body 212 between the first and second radial shoulders 214*a,b*. Consequently, when the collet lugs 216 are axially aligned with the enlarged outer diameter portion 402, the deflection potential of the collet fingers 208 at that location will be reduced significantly such that little or no radial deflection occurs when the collet lugs 216 locate and engage a corresponding indicating profile 404. Instead, as the collet lugs 216 locate and engage the indicating profile 404, the collet fingers 208 are radially supported by the enlarged outer diameter portion 402, which prevents the collet fingers 208 from deflecting radially inward. Consequently, the indicating profile 404 may serve as a no-go profile that prevents the collet 400 from advancing further within the wellbore 106.

As with the above-described embodiments, over long durations of use and numerous engagements with the indicating profile 402, the collet lugs 216 may become marred, damaged, and/or worn, which could adversely affect how it engages the indicating profile 402. For instance, as the edges of the collet lugs 216 wear and become damaged through repeated axial engagement against the indicating profile 402, there is a greater potential for the collet lugs 216 to bypass the indicating profile 402 instead of stopping at the indicating profile 402. In such cases, the collet lugs 216 may be removed and replaced or rehabilitated, as generally described above.

Figure 5A:
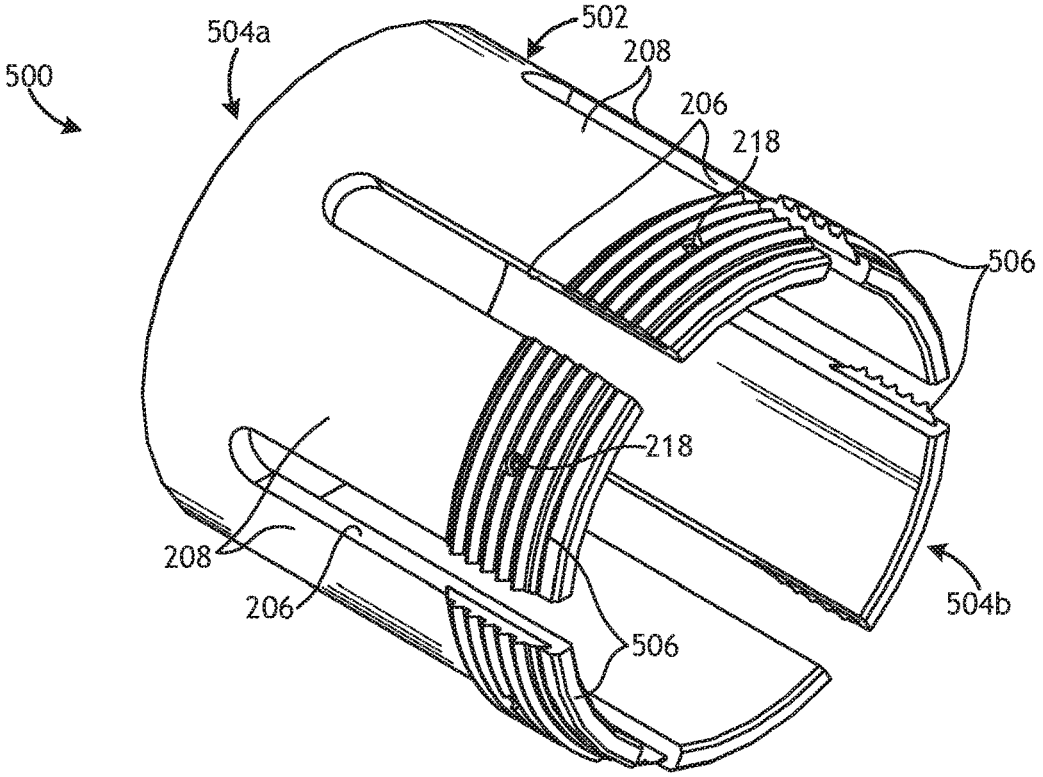
FIGS. 5A and 5B are views of another exemplary embodiment of a collet.
Figure 5B:
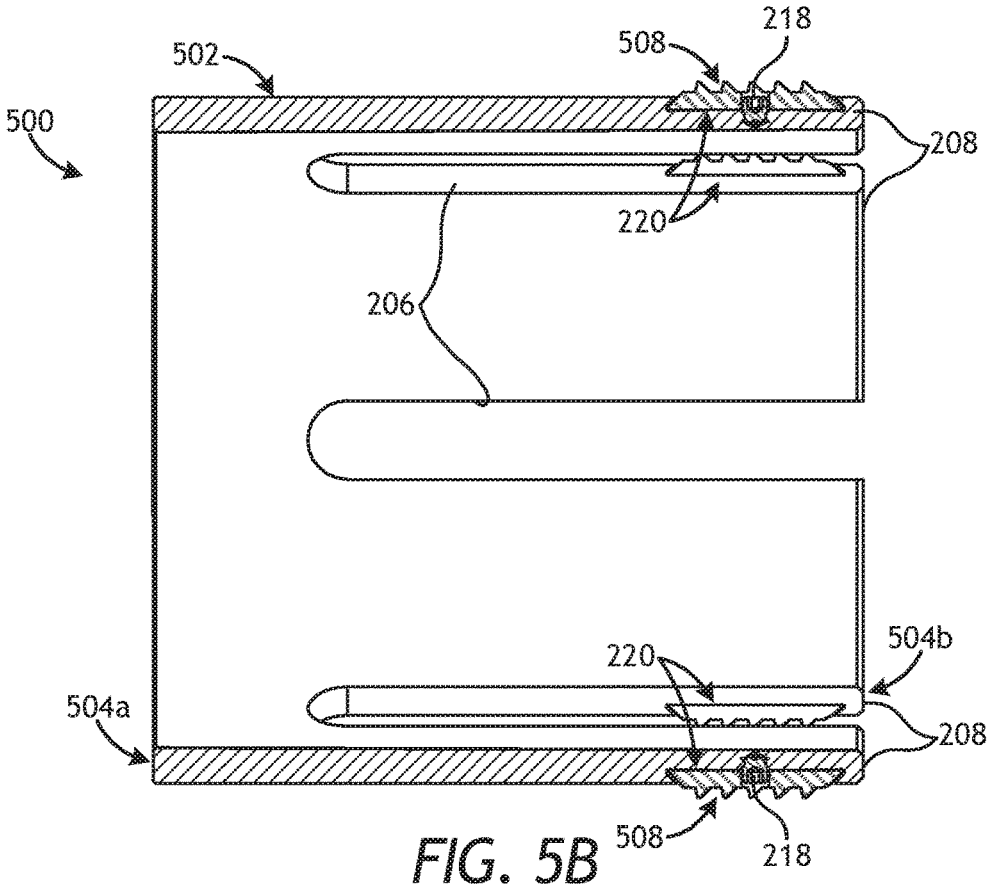

FIGS. 5A and 5B are views of another exemplary embodiment of a collet 500, according to one or more embodiments. More particularly, FIG. 5A is an isometric view of the collet 500, and FIG. 5B is a cross-sectional side view of the collet 500. As illustrated, the collet 500 may include a generally cylindrical body 502 having a first end 504*a* and a second end 504*b* opposite the first end 504*a*. A plurality of longitudinally extending orifices 206 are defined through the body 502, and thereby provide a corresponding plurality of axially extending collet fingers 208. In the illustrated embodiment, the collet fingers 208 are depicted as generally extending between the first and second ends 504*a,b* and extending through and penetrating the second end 504*b*. As a result, the collet fingers 208 will be radially supported at only the first end 504*a*, while collet fingers 208 at the second end 504*b* will operate as cantilever beams or extensions able to radially deflect.

The collet 500 may further include at least one collet lug 506 secured to each collet finger 208 and extending radially outward therefrom. Similar to the collet lugs 216 described in prior embodiments, the collet lugs 506 may be removably coupled to the corresponding collet fingers 208 using any of the reversible mechanical attachment means discussed herein. In the illustrated embodiment, the collet lugs 506 are removably coupled to a corresponding collet finger 208 using a mechanical fastener 218. When desired, the mechanical fasteners 218 may be removable to enable a user to remove the collet lugs 506. Moreover, in the illustrated embodiment, the collet lugs 506 are depicted as being received and otherwise seated within corresponding grooves 220 defined in the outer surface of the corresponding collet finger 208.

Unlike the collet lugs 216 described in prior embodiments, the collet lugs 506 may provide and otherwise define an engaging profile 508. In some embodiments, the engaging profile 508 may be a helical or non-helical threaded profile configured to mate with a matching profile provided on a given indicator profile. As with the above-described embodiments, over long durations of use and numerous engagements with indicating profiles, the collet lugs 506 and, more particularly, the engaging profile 508, may become marred, damaged, and/or worn. For instance, as the edges of the engaging profile 508 wear and become damaged through repeated engagement against various indicating profiles, there is a greater potential for the collet lugs 506 to misalign with the an indicating profile or bypass the indicating profile altogether. In such cases, the collet lugs 506 may be removed and replaced or rehabilitated, as generally described above.

Embodiments disclosed herein include:

A. A collet that includes a cylindrical body, a plurality of longitudinally-extending orifices defined through the body and thereby providing one or more axially-extending collet fingers, and a collet lug removably coupled to each axially-extending collet finger.

B. A method that includes removing a used collet lug from a collet finger of a collet, the used collet lug being removably coupled to the collet finger, and increasing a snap force of the collet by at least one of replacing the used collet lug with a new collet lug, rehabilitating the used collet lug and reattaching a rehabilitated collet lug to the collet finger, and moving the used collet lug to a location on the collet finger closer to an axial end of the collet.

C. A method that includes removing a plurality of used collet lugs from a corresponding plurality of collet fingers of a collet, wherein each used collet lug is removably coupled to the corresponding plurality of collet fingers at a first axial location with a mechanical fastener, and increasing a snap force of the collet by moving the plurality of used collet lugs to a second axial location on the corresponding plurality of collet fingers, wherein the second axial location is to an axial end of the collet as compared to the first axial location.

Each of embodiments A, B, and C may have one or more of the following additional elements in any combination: Element 1: wherein the collet lug is removably coupled to at least one of the one or more axially extending fingers using a reversible mechanical attachment means selected from the group consisting of a mechanical fastener, a shrink fit, an interference fit, an adhesive, a weld, or any combination thereof. Element 2: further comprising a groove defined in an outer or inner surface of the one or more axially-extending collet fingers, wherein the collet lug is received within the groove. Element 3: wherein a cross-sectional shape of the groove is a dovetail shape and the collet lug is correspondingly shaped to be received within the groove. Element 4: wherein the groove is a first groove and the collet further comprises a second groove defined in the outer surface of the one or more axially-extending collet fingers and axially offset from the first groove, wherein a deflection potential of the one or more axially-extending collet fingers is varied by moving the collet lug to the second groove. Element 5: wherein a snap force of the collet is increased by replacing the collet lug with a new collet lug. Element 6: wherein the new collet lug is made of a hard material selected from the group consisting of a carbide, a carbide embedded in a matrix of cobalt or nickel by sintering, a ceramic, a surface hardened metal, a surface coated metal, a cermet-based material, a metal matrix composite, a nanocrystalline metallic alloy, an amorphous alloy, a hard metallic alloy, diamond, a metal boride, or any combination thereof. Element 7: further comprising a collet mandrel received within the cylindrical body and radially supporting at least a portion of the cylindrical body, wherein the collet lug is axially and radially aligned with an enlarged outer diameter portion of the collet mandrel. Element 8: wherein the collet lug provides an engaging profile.

Element 9: wherein replacing the used collet lug with the new collet lug comprises replacing the used collet lug a new collet lug made of a hard material selected from the group consisting of a carbide, a carbide embedded in a matrix of cobalt or nickel by sintering, a ceramic, a surface hardened metal, a surface coated metal, a cermet-based material, a metal matrix composite, a nanocrystalline metallic alloy, an amorphous alloy, a hard metallic alloy, diamond, a metal boride, or any combination thereof. Element 10: wherein rehabilitating the used collet lug comprises hardfacing the used collet lug to obtain the rehabilitated collet lug. Element 11: wherein the used collet lug is removably coupled to the collet finger using a reversible mechanical attachment means selected from the group consisting of a mechanical fastener, a shrink fit, an interference fit, an adhesive, a weld, or any combination thereof. Element 12: wherein a groove is defined in an outer surface of the collet finger and the used collet lug is removably coupled to the collet finger within the groove, and wherein removing the used collet lug from the collet finger comprises extricating the used collet lug from the groove. Element 13: wherein the groove is a first groove and the collet further comprises a second groove defined in the outer surface of the collet finger and axially offset from the first groove, and wherein moving the used collet lug to the location on the collet finger closer to the axial end of the collet comprises receiving the collet lug within the second groove.

Element 14: wherein moving the plurality of used collet lugs to a second axial location on the corresponding plurality of collet fingers further comprises replacing the plurality of used collet lugs with a plurality of new collet lugs. Element 15: wherein one or more of the plurality of new collet lugs are made of a hard material selected from the group consisting of a carbide, a carbide embedded in a matrix of cobalt or nickel by sintering, a ceramic, a surface hardened metal, a surface coated metal, a cermet-based material, a metal matrix composite, a nanocrystalline metallic alloy, an amorphous alloy, a hard metallic alloy, diamond, a metal boride, or any combination thereof. Element 16: wherein a first set of grooves is defined in an outer surface of the plurality of collet fingers at the first axial location and each used collet lug is removably coupled to the plurality of collet fingers within the first set of grooves, and wherein removing the plurality of used collet lugs from the corresponding plurality of collet fingers comprises extricating the plurality of used collet lugs from the first set of grooves. Element 17: wherein a second set of grooves is defined in the outer surface of the plurality of collet fingers at the second axial location and axially offset from the first set of grooves, and wherein moving the plurality of used collet lugs to the second axial location comprises receiving the plurality of collet lugs within the second set of grooves.

By way of non-limiting example, exemplary combinations applicable to A, B, and C include: Element 2 with Element 3; Element 2 with Element 4; Element 5 with Element 6; Element 12 with Element 13; and Element 14 with Element 15.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A collet, comprising:

a cylindrical body;

a plurality of longitudinally-extending orifices defined through the body and thereby providing one or more axially-extending collet fingers;

a collet lug removably coupled to each axially-extending collet finger; and a collet mandrel received within the cylindrical body and radially supporting at least a portion of the cylindrical body, wherein the collet lug is axially and radially aligned with an enlarged outer diameter portion of the collet mandrel.

2. The collet of claim 1, further comprising a groove defined in an outer or inner surface of the one or more axially-extending collet fingers, wherein the collet lug is received within the groove.

3. The collet of claim 2, wherein a cross-sectional shape of the groove is a dovetail shape and the collet lug is correspondingly shaped to be received within the groove.

4. The collet of claim 2, wherein the groove is a first groove and the collet further comprises a second groove defined in the outer surface of the one or more axially-extending collet fingers and axially offset from the first groove, wherein a deflection potential of the one or more axially-extending collet fingers is varied by moving the collet lug to the second groove.

5. The collet of claim 1, wherein a snap force of the collet is increased by replacing the collet lug with a new collet lug.

6. The collet of claim 5, wherein the new collet lug is made of a hard material selected from the group consisting of a carbide, a carbide embedded in a matrix of cobalt or nickel by sintering, a ceramic, a surface hardened metal, a surface coated metal, a cermet-based material, a metal matrix composite, a nanocrystalline metallic alloy, an amorphous alloy, a hard metallic alloy, diamond, a metal boride, or any combination thereof.

7. The collet of claim 1, wherein the collet lug provides an engaging profile.

8. The collet of claim 7, wherein the engaging profile mates with at least one selected from a group comprising a downhole structure and a downhole tool.

9. The collet of claim 1, wherein the collet lug is removably coupled to at least one of the one or more axially extending fingers using a reversible mechanical attachment means selected from the group consisting of a mechanical fastener, a shrink fit, an interference fit, an adhesive, a weld, or any combination thereof.

* * * * *